US012209783B2

(12) United States Patent
Zou et al.

(10) Patent No.: US 12,209,783 B2
(45) Date of Patent: Jan. 28, 2025

(54) LOW AMBIENT TEMPERATURE HEAT PUMP WATER HEATER SYSTEMS, HEAT EXCHANGERS, AND METHODS THERETO

(71) Applicant: Rheem Manufacturing Company, Atlanta, GA (US)

(72) Inventors: Yang Zou, Frisco, TX (US); Sivakumar Gopalnarayanan, Plano, TX (US); Atilhan Manay, Roswell, GA (US); Vishwanath Reddy Ardha, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 17/510,592

(22) Filed: Oct. 26, 2021

(65) Prior Publication Data

US 2023/0128232 A1 Apr. 27, 2023

(51) Int. Cl.
*F24H 4/02* (2022.01)
*F25B 7/00* (2006.01)
(Continued)

(52) U.S. Cl.
CPC ..... *F25B 49/027* (2013.01); *F24H 4/02* (2013.01); *F25B 7/00* (2013.01); *F25B 41/00* (2013.01);
(Continued)

(58) Field of Classification Search
CPC ..... F24F 4/00; F24F 4/02; F24F 4/04; F24D 17/02; F24D 19/1054; F24D 19/1072;
(Continued)

(56) References Cited

U.S. PATENT DOCUMENTS 6,446,450 B1 * 9/2002 Pressler ..... F25B 41/20 62/211
6,616,428 B2 9/2003 Ebara et al.
(Continued)

FOREIGN PATENT DOCUMENTS

CA 3019773 A1 4/2019
EP 0072543 A2 2/1983
(Continued)

OTHER PUBLICATIONS

PCT, "International Search Report & Written Opinion" Application No. PCT/US2022/044886, mailed Dec. 19, 2022, 14 pages.
(Continued)

*Primary Examiner* — Jonathan Bradford
(74) *Attorney, Agent, or Firm* — Eversheds Sutherland (US) LLP

(57) ABSTRACT

Systems and methods for a heat pump water heater can include a heat pump water heater system having an evaporator, a condenser, a vapor injection line, a compressor, and a multi-fluid heat exchanger. The vapor injection line can include an expansion valve to transition refrigerant received from the condenser at a first pressure to a second pressure. The compressor can be configured to circulate refrigerant through the condenser, the multi-fluid heat exchanger, the vapor injection line, and the evaporator. The multi-fluid heat exchanger can be configured to receive refrigerant at a first pressure from the condenser, refrigerant at a second pressure from the vapor injection line, and water. The multi-fluid heat exchanger can further facilitate heat transfer between the refrigerants at the first and second pressures and the water to preheat the water before the water is passed through the condenser.

15 Claims, 9 Drawing Sheets

(51) Int. Cl.

| | |
|---|---|
| ***F25B 41/00*** | (2021.01) |
| ***F25B 49/02*** | (2006.01) |
| ***F28F 3/04*** | (2006.01) |
| *F25B 1/10* | (2006.01) |

(52) U.S. Cl.
CPC ..... *F28F 3/048* (2013.01); *F25B 1/10* (2013.01); *F25B 49/02* (2013.01); *F25B 2339/047* (2013.01); *F25B 2400/13* (2013.01); *F25B 2500/31* (2013.01); *F25B 2600/2503* (2013.01); *F25B 2600/2509* (2013.01); *F25B 2700/2104* (2013.01); *F25B 2700/2106* (2013.01)

(58) Field of Classification Search
CPC .... F25B 41/00; F25B 49/027; F25B 2400/13; F25B 2500/31; F25B 2600/2503; F25B 2600/2509; F25B 2700/2104
See application file for complete search history.

(56) References Cited

U.S. PATENT DOCUMENTS

| | | | | |
|---|---|---|---|---|
| 7,272,948 | B2 | 9/2007 | Taras et al. | |
| 7,469,555 | B2 | 12/2008 | Taras et al. | |
| 9,157,439 | B2 | 10/2015 | Brostrom et al. | |
| 9,188,372 | B2 | 11/2015 | Thomas et al. | |
| 9,448,013 | B2 | 9/2016 | Ito et al. | |
| 9,651,317 | B2 | 5/2017 | Jindou et al. | |
| 9,677,818 | B2 | 6/2017 | Numata et al. | |
| 9,920,963 | B1 * | 3/2018 | Rafalovich | F25B 13/00 |
| 10,035,937 | B2 | 7/2018 | Yana Motta et al. | |
| 10,180,257 | B2 | 1/2019 | Cur et al. | |
| 10,287,469 | B2 | 5/2019 | Kontomaris et al. | |
| 10,488,089 | B2 | 11/2019 | Kester et al. | |
| 10,539,358 | B2 | 1/2020 | Suzuki et al. | |
| 10,598,418 | B2 | 3/2020 | Shen et al. | |
| 11,378,290 | B2 | 7/2022 | Locke et al. | |
| 11,585,575 | B2 | 2/2023 | Zou et al. | |
| 2006/0225445 | A1 | 10/2006 | Lifson et al. | |
| 2008/0041072 | A1 | 2/2008 | Seefeldt | |
| 2008/0190126 | A1 | 8/2008 | Holden et al. | |
| 2009/0293515 | A1 * | 12/2009 | Lifson | F25B 30/02 418/55.1 |
| 2010/0193155 | A1 | 8/2010 | Nakatani et al. | |
| 2011/0214439 | A1 | 9/2011 | Lifson et al. | |
| 2011/0314845 | A1 | 12/2011 | Lifson et al. | |
| 2017/0131034 | A1 | 5/2017 | Ribarov et al. | |
| 2017/0349451 | A1 | 12/2017 | Lockwood et al. | |
| 2018/0202710 | A1 * | 7/2018 | Miller | F28C 1/00 |
| 2018/0259273 | A1 * | 9/2018 | Wang | F28D 9/0037 |
| 2019/0186801 | A1 | 6/2019 | Kopko et al. | |
| 2019/0368817 | A1 | 12/2019 | Huang et al. | |
| 2020/0149749 | A1 | 5/2020 | Tallakson et al. | |
| 2021/0048251 | A1 | 2/2021 | Sathyamurthi et al. | |
| 2021/0348811 | A1 | 11/2021 | Shanmugam et al. | |
| 2022/0214055 | A1 | 7/2022 | Iwasaki et al. | |

FOREIGN PATENT DOCUMENTS

| | | | |
|---|---|---|---|
| EP | 2306122 | B1 | 7/2017 |
| EP | 3193102 | A1 | 7/2017 |
| EP | 3351871 | A1 | 7/2018 |
| EP | 3872412 | A1 | 9/2021 |
| JP | 5665937 | B1 | 2/2015 |
| KR | 101681585 | B1 | 12/2016 |
| KR | 20190057768 | A | 5/2019 |
| SK | 20170118 | A3 | 6/2019 |
| WO | 2014156190 | A1 | 2/2017 |
| WO | 2017103988 | A1 | 6/2017 |

OTHER PUBLICATIONS

PCT "International Search Report & Written Opinion" Application No. PCT/US2022/044882, mailed Dec. 19, 2022, 13 pages.

* cited by examiner

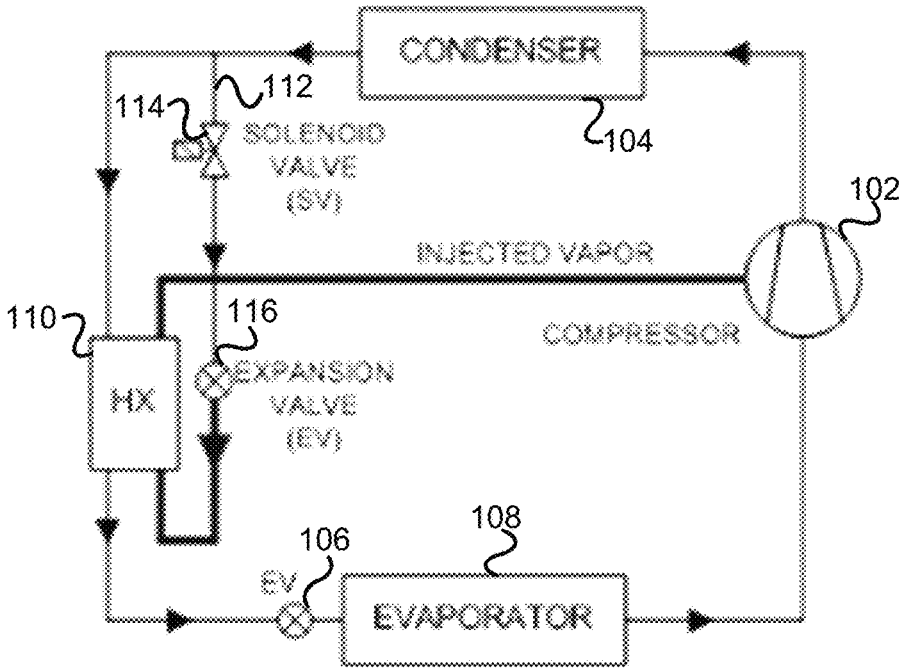
FIG. 1A - PRIOR ART
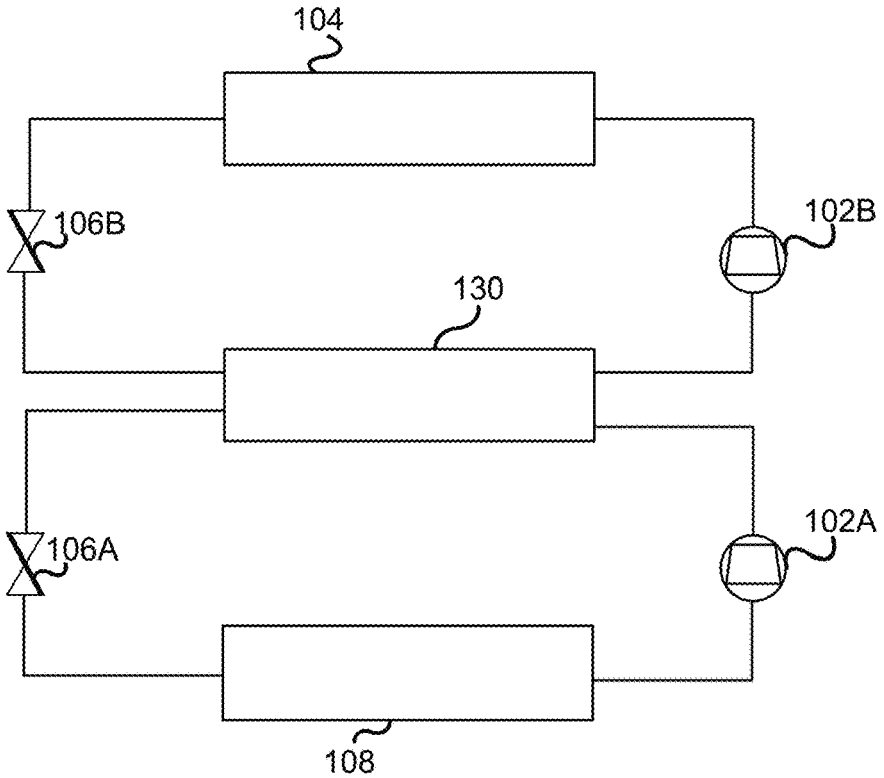
FIG. 1B - PRIOR ART

LOW AMBIENT TEMPERATURE HEAT PUMP WATER HEATER SYSTEMS, HEAT EXCHANGERS, AND METHODS THERETO

FIELD OF TECHNOLOGY

The disclosed technology relates generally to heat pump systems and, more particularly, to heat pump systems configured to operate in low ambient temperatures.

BACKGROUND

Heat pump water heater systems are becoming increasingly more common as many industries move away from pollution-emitting combustion hot water heater systems and toward more efficient and environmentally friendly systems. Rather than create heat energy directly through combustion or other energy sources, heat pump water heaters are generally designed to transfer heat from a heat source (e.g., ambient air, geothermal heat sources, etc.) to water stored in a tank using a vapor-compression cycle. Heat pump water heaters can be used to efficiently heat water for end uses such as household hot water use, commercial hot water use, radiator space heating, floor space heating, and other similar uses.

As illustrated in FIGS. 1A and or 1B, existing heat pump systems typically include at least a compressor 102, a condenser 104, an expansion valve 106, and an evaporator 108. As the refrigerant is circulated by the compressor 102 through the condenser 104, expansion valve 106, and evaporator 108, the refrigerant can transition between a vapor and a liquid, causing heat to be absorbed by the refrigerant at the evaporator 108 and released by the refrigerant at the condenser 104. The condenser 104 can be a heat exchanger configured to transfer the heat from the refrigerant to the water. By utilizing a vapor-compression cycle, heat pumps are able to heat water efficiently without creating harmful combustion gasses or other pollutant byproducts.

To help increase the efficiency of the heat pump, some heat pump water heater systems include an injection line 112 that is configured to inject vapor refrigerant into the compressor 102 to reduce the discharge temperature. As illustrated in FIG. 1A, the injection line 112 can be located between the compressor 102 and a location in the refrigerant line downstream of the condenser 104. The injection line 112 can include a supplemental expansion valve 116 and a supplemental heat exchanger 110. High pressure liquid refrigerant from the condenser 104 can be directed to the injection line 112 by a solenoid valve 114. The high-pressure liquid refrigerant can then be expanded into two-phase fluid by the supplemental expansion valve 116 and then transitioned into a superheated vapor via the supplemental heat exchanger 110 before being routed to the compressor 102. The injected superheated vapor can help to reduce the discharge temperature of the compressor 102 to increase the overall efficiency of the heat pump system.

Unfortunately, heat pump water heaters, even those having vapor injection, have been limited in their application due to many heat pump water heater systems being unable to effectively heat water in low ambient temperatures. Thus, heat pump water heaters have typically not been effectively implemented in regions having cooler climates. This is because the heat pump must use more energy to heat the water to the threshold temperature as the ambient temperature decreases because the efficiency of the heat pump decreases as the ambient temperature decreases.

One method of sufficiently heating the water in cool climates includes arranging two heat pumps in a cascading arrangement. As illustrated in FIG. 1B, existing cascade heat pump water heater systems can include two or more compressors 102A, 102B and two or more expansion valves 106A, 106B. The first compressor 102A can circulate a first refrigerant through an intermediate heat exchanger 130, a first expansion valve 106A, and an evaporator 108. The intermediate heat exchanger 130 can be in thermal communication with a second refrigerant circulated by the second compressor 102B to heat the second refrigerant. Because the second refrigerant is heated by the first refrigerant, the second refrigerant can be heated to a higher temperature to sufficiently heat water. This is true even in cooler climates. Because cascading heat pump systems must operate both compressors in order to heat water, cascading heat pump systems tend to be more expensive to manufacture and operate than single stage heat pump systems. This is particularly true in regions where the climate is warm for some time during the year. As the ambient temperature rises above a low threshold temperature, there is no longer a need to operate both compressors and the cascading heat pump water heater arrangement becomes unnecessary and inefficient.

What is needed, therefore, is a heat pump water heater system that can sufficiently heat water in low ambient temperature conditions while also increasing the overall efficiency of the heat pump water heater in both cool and warm ambient temperatures.

SUMMARY

These and other problems are addressed by the technology disclosed herein. The disclosed technology relates generally to heat pump systems and, more particularly, to heat pump systems capable of operating in low ambient temperatures. The disclosed technology can include a heat pump water heater system having an evaporator configured to facilitate heat exchange between ambient air and a refrigerant, a condenser configured to facilitate heat exchange between the refrigerant and water, and a vapor injection line comprising an expansion valve and configured to receive the refrigerant from the condenser. The expansion valve can be configured to transition the refrigerant received from the condenser from a first pressure to a second pressure. The heat pump water heater system can further include a compressor that can be configured to circulate the refrigerant through the evaporator, the condenser, the vapor injection line, and a multi-fluid heat exchanger.

The multi-fluid heat exchanger can be configured to receive the refrigerant at the first pressure from the condenser, receive the refrigerant at the second pressure from the vapor injection line, receive the water from a water source, and facilitate heat exchange between the refrigerant at the first pressure, the refrigerant at the second pressure, and the water. The first pressure can be greater than the second pressure. When the refrigerant at the second pressure passes through the multi-fluid heat exchanger, the refrigerant at the second pressure can be transitioned into a superheated vapor by receiving heat from the refrigerant at the first pressure.

The compressor can be further configured to receive the superheated vapor from the multi-fluid heat exchanger via the vapor injection line. The water can be configured to first pass through the multi-fluid heat exchanger and then through the condenser. In this way, the multi-fluid heat exchanger can be configured to preheat the water.

The vapor injection line can further include a control valve that is configured to control a flow of the refrigerant from the condenser. The control valve can be a solenoid valve.

The multi-fluid heat exchanger can include a shell configured to receive the refrigerant at the first pressure, a first tube bundle configured to receive the refrigerant at the second pressure, and a second tube bundle configured to receive the water.

The multi-fluid heat exchanger can include a first tube configured to receive the water, a second tube configured to house the first tube and receive the refrigerant at the second pressure, and a third tube configured to house the first tube and the second tube and receive the refrigerant at the first pressure. The refrigerant at the first pressure and the refrigerant at the second pressure can be in counterflow with respect to each other.

The multi-fluid heat exchanger can be a microchannel heat exchanger comprising a first microchannel tube configured to receive the refrigerant at the first pressure, a second microchannel tube configured to receive the refrigerant at the second pressure, and a housing having a plurality of plates and configured to receive the water. The refrigerant at the first pressure and the refrigerant at the second pressure can be in counterflow with respect to each other.

The heat pump water heater system can further include a control valve that is configured to control a flow of the refrigerant from the condenser, an ambient air temperature sensor configured to detect a temperature of ambient air, and a controller. The controller can be configured to receive ambient air temperature data from the ambient air temperature sensor. The controller can further determine, based at least in part on the ambient air temperature data, whether the temperature of the ambient air is less than or equal to a low ambient temperature threshold. In response to determining that the temperature of the ambient air is less than or equal to the low ambient temperature threshold, the controller can output a control signal to open the control valve to permit the refrigerant to flow through the vapor injection line.

In response to determining that the temperature of the ambient air is greater than the low ambient temperature threshold, the controller can be configured to output a control signal to close the control valve to prevent the refrigerant from flowing through the vapor injection line.

The heat pump water heater system can further include a control valve configured to control a flow of the refrigerant from the condenser, a water temperature sensor configured to detect a temperature of the water, and a controller. The controller can be configured to receive water temperature data from the water temperature sensor and determine, based at least in part on the water temperature data, whether the temperature of the water is greater than or equal to a high water temperature threshold. In response to determining that the temperature of the water is greater than or equal to the high water temperature threshold, the controller can be configured to output a control signal to open the control valve.

In response to determining that the temperature of the water is less than the high water temperature threshold, the controller can be further configured to output a control signal to close the control valve to prevent the refrigerant from flowing through the vapor injection line.

The disclosed technology can further include a heat pump water heater system having a first evaporator configured to facilitate heat exchange between ambient air and a first refrigerant, a first condenser configured to facilitate heat exchange between the first refrigerant and water, a first compressor configured to circulate the first refrigerant through the first evaporator and the first condenser, a second evaporator configured to facilitate heat exchange between the water and a second refrigerant, a second condenser configured to facilitate heat exchange between the second refrigerant and the water, and a second compressor configured to circulate the second refrigerant through the second evaporator and the second condenser.

The first condenser and the second evaporator can be a single multi-fluid heat exchanger configured to facilitate heat exchange between the first refrigerant, the second refrigerant, and the water. The multi-fluid heat exchanger can include a first microchannel tube configured to receive the first refrigerant, a second microchannel tube configured to receive the second refrigerant, and a housing having a plurality of plates and configured to receive the water.

The multi-fluid heat exchanger can be configured to pass the first refrigerant and the second refrigerant in counterflow directions therethrough.

The heat pump water heater system can further include a control valve configured to control a flow of the water, a water pump configured to circulate the water through the first condenser and the second evaporator, an ambient air temperature sensor configured to detect a temperature of ambient air, and a controller. The controller can be configured to receive ambient air temperature data from the ambient air temperature sensor and determine, based at least in part on the ambient air temperature data, whether the temperature of the ambient air is less than or equal to a low ambient temperature threshold. In response to determining that the temperature of the ambient air is less than or equal to the low ambient temperature threshold, the controller can be configured to output a first control signal to turn on the first compressor, output a second control signal to turn on the second compressor, output a third control signal to turn on the water pump, and output a fourth control signal to actuate the control valve to cause water to circulate between the first condenser and the second evaporator.

Additional features, functionalities, and applications of the disclosed technology are discussed herein in more detail.

BRIEF DESCRIPTION OF THE DRAWINGS

The accompanying drawings, which are incorporated in and constitute a part of this specification, illustrate various aspects of the presently disclosed subject matter and serve to explain the principles of the presently disclosed subject matter. The drawings are not intended to limit the scope of the presently disclosed subject matter in any manner.

FIGS. 1A and 1B illustrate existing heat pump water heating systems.

DETAILED DESCRIPTION

Figure 2:
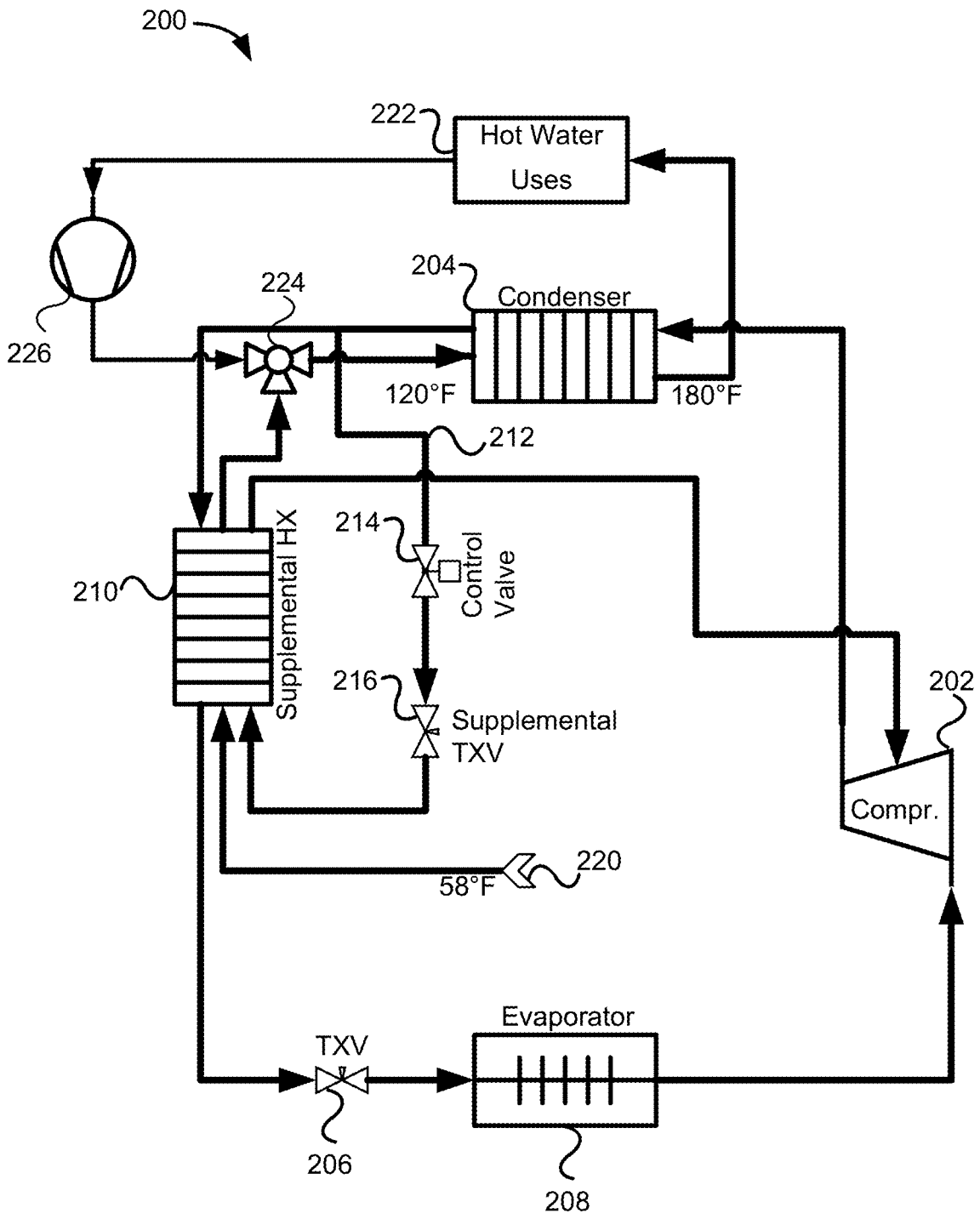
FIG. 2 illustrates a schematic diagram of an example heat pump water heater system, in accordance with the disclosed technology.

The disclosed technology can include heat pump water heater systems that are configured to operate in both cool and warm climates. For example, the disclosed technology can include heat pump water heater systems that can sufficiently heat water in warm climates as well as in climates where the ambient temperature can remain below freezing temperatures (e.g., less than 32° F.) for extended periods of time. As a non-limiting example, the heat pump water heater systems described herein can be configured to operate in ambient temperatures as low as −10° F. The heat pump water heater system can include a multi-fluid heat exchanger capable of exchanging heat between two refrigerant sources and water. The multi-fluid heat exchanger can be configured to preheat water before the water is heated by the condenser of the heat pump water heater. The multi-fluid heat exchanger can further heat refrigerant to cause the refrigerant to be a superheated vapor that can be injected into the compressor to increase the efficiency of the heat pump water heater system. The disclosed technology can also include cascading heat pump water heater systems that can be configured to efficiently heat water in both cool and warm ambient temperature conditions. Further configurations and advantages of the disclosed technology will become apparent throughout this disclosure.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. In particular, the presently disclosed subject matter is described in the context of being systems and methods for use with a heat pump water heating system. The present disclosure, however, is not so limited, and can be applicable in other contexts. The present disclosure can, for example, include devices and systems for use with air conditioning systems, refrigeration systems, pool water heater systems, and other similar systems. Furthermore, although described in the context of being a water heater, the disclosed technology can be configured to heat fluids other than water. For example, the disclosed technology can be configured to heat air, oil, glycol, refrigerants, silicones, or other fluids. Furthermore, the disclosed technology can be implemented in various commercial and industrial fluid heating systems used to heat fluids other than water. Accordingly, when the present disclosure is described in the context of a heat pump water heater system, it will be understood that other implementations can take the place of those referred to.

Although described herein as being a heat pump water heater configured to be deployed in low ambient temperature conditions, the disclosed technology can also be implemented in air conditioning systems configured to operate in high or low ambient temperature conditions. For example, the disclosed technology is described herein as having a water flow path to heat water to a high temperature using one or more heat exchangers. If the disclosed technology is deployed in an air heating context, the water flow path described herein can be and air flow path and the system can function much the same as the water heating system (e.g., the system will heat the air to a sufficient temperature even if the ambient temperature is low). If the disclosed technology is deployed in an air conditioning context (i.e., space cooling), the water flow path described herein can be an air flow path and the system can be configured to operate a first compressor in moderate ambient temperature conditions and both the first and a second compressor in high ambient temperature conditions. Thus, although described in the context of being a water heating system, one of skill in the art will appreciate that the disclosed technology can also be applicable to air conditioning systems without departing from the scope of this disclosure.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Referring now to the drawings, in which like numerals represent like elements, the present disclosure is herein described. FIG. 2 illustrates a heat pump water heater (HPWH) 200 that is configured to be operated in low ambient temperature conditions. The HPWH 200, for example, can be operated in regions where the ambient temperature can remain below freezing for extended periods of time. The HPWH 200 can include a compressor 202 that can be configured to circulate refrigerant through a condenser 204, a thermal expansion valve (TXV) 206, and an evaporator 208. As will be appreciated by one of skill in the art, as the refrigerant is circulated through the condenser 204, the TXV 206, and the evaporator 208, the refrigerant can absorb heat at the evaporator 208 from a heat source (e.g., ambient air, a heated fluid, geothermal heat sources, etc.) and transfer the heat to water passed through the condenser 204.

The HPWH 200 can include a vapor injection line 212 that can be configured to permit refrigerant in a fluid path downstream of the condenser 204 to pass through a supplemental TXV 216 and a supplemental heat exchanger 210. The supplemental TXV 216 can cause the refrigerant to transition from a high-pressure liquid exiting the condenser 204 to an intermediate-pressure two-phase fluid. In other words, the vapor injection line 212 can be configured to facilitate refrigerant at a first pressure exiting the condenser 204 to transition to a refrigerant at a second pressure. Furthermore, the supplemental heat exchanger 210 can be configured to facilitate the intermediate-pressure two phase fluid to transition to a superheated vapor. The superheated vapor can then be directed by the vapor injection line 212 to the compressor 202 to help increase the efficiency of the compressor 202.

To further increase the efficiency of the HPWH 200 and enable the HPWH 200 to effectively heat water in cooler climates, the supplemental heat exchanger 210 can be configured to preheat the water from a water source 220 prior to the water passing through the condenser 204. The supplemental heat exchanger 210 can permit at least three fluids (e.g., a multi-fluid heat exchanger) to pass through the supplemental heat exchanger 210. For example, the supplemental heat exchanger 210 can include a first passage configured to allow a first refrigerant to pass through the supplemental heat exchanger 210, a second passage configured to allow a second refrigerant to pass through the supplemental heat exchanger 210, and a third passage configured to allow water to pass through the supplemental heat exchanger 210. By passing all three fluids through the supplemental heat exchanger 210, heat can be exchanged between two of the fluids or between all three fluids. As will be appreciated by one of skill in the art, heat will pass from a fluid having a higher temperature to a fluid having a lower temperature. To illustrate, the high-pressure two-phase fluid from the condenser 204 and the intermediate-pressure two-phase fluid from the supplemental TXV 216 can both pass through the supplemental heat exchanger 210 as illustrated in FIG. 2. As the high-pressure two-phase fluid or liquid refrigerant can be at a greater temperature than the intermediate-pressure two-phase fluid, heat can be transferred from the high-pressure two-phase fluid or liquid refrigerant and to the intermediate-pressure two-phase fluid or liquid refrigerant to cause the intermediate-pressure two-phase fluid to become superheated vapor. The superheated vapor can then be directed by the vapor injection line 212 to the compressor 202 to help increase the efficiency of the heat pump cycle. Similarly, as the temperature of the high pressure two-phase fluid or liquid refrigerant from the condenser 204 and the intermediate pressure two-phase fluid or liquid refrigerant from the supplemental TXV 216 are likely to both be greater than the temperature of the water, the water can be heated as it is passed through the supplemental heat exchanger 210. In this way, the supplemental heat exchanger 210 can be configured to preheat the water before the water is passed through the condenser.

To further facilitate heat transfer between the high-pressure two-phase fluid or liquid refrigerant and the intermediate-pressure two-phase fluid or liquid refrigerant, the high-pressure two-phase fluid or liquid refrigerant and the intermediate-pressure two-phase fluid or liquid refrigerant can be in counterflow with respect to each other. Similarly, the water and the high-pressure two-phase fluid can be in counterflow with respect to each other.

The HPWH 200 can be configured to receive water from a water source 220. For example, the water source 220 can be a city water supply, a well, a stream, a spring, or any other suitable water source for the particular application. The water from the water source 220 can be at a first temperature that is normally cooler than the rest of the water in the system prior to entering the supplemental heat exchanger 210. As a non-limiting example, the water entering the HPWH 200 from the water source 220 can be approximately 58° F. As the water passes through the supplemental heat exchanger 210, the water can be heated to a first target temperature. For example, the water can be heated to approximately 120° F. as it passes through the supplemental heat exchanger 210. As the water passes through the condenser 204, the water can be further heated to a second target temperature that is greater than the first target temperature. For example, the water can be heated to approximately 180° F. as it passes through the condenser 204. As will be appreciated by one of skill in the art, the various example temperatures are offered merely for illustrative purposes and should not be construed as limiting as the HPWH 200 can be configured to heat the water to any suitable temperature for the application.

As the water is heated, the water can be used for various hot water uses 222 including, but not limited, supply heated water to a faucet, dishwashing, clothes washing, radiator space heating, floor space heating, and other suitable hot water uses 222. Furthermore, as illustrated in FIG. 2 and depending on the application, the water can be circulated by a water pump 226 back through at least the condenser 204 to reheat the water. For example, where the water is used for space heating, the HPWH 200 can circulate water back through the condenser 204 to reheat the water and continue heating the space. As will be appreciated, the water may not need to be heated to the same temperature for space heating as would be necessary for other water uses. In some applications, for example, water at a temperature of approximately 80° F. to 100° F. would be sufficient for space heating while water at a temperature of greater than 120° F. would be necessary for other hot water uses 222. In this case, the water used for space heating can be heated by just the supplemental heat exchanger 210 while the water used for other hot water uses 222 can be heated by both the supplemental heat exchanger 210 and the condenser 204. Although not illustrated in FIG. 2, the HPWH 200 can include a water line that can route water downstream of the supplemental heat exchanger 210 but upstream of the condenser 204 to be used for space heating.

To help control the flow of the water, the HPWH 200 can include a water control valve 224. The water control valve 224 can be positioned downstream of the supplemental heat exchanger 210 and upstream of the condenser 204. The water control valve 224 can be any type of valve suitable for the application. For example, the water control valve 224 can be a ball valve, a plug valve, a butterfly valve, a gate valve, a globe valve, a needle valve, a coaxial valve, an angle seat valve, a three-way valve, or any other type of valve that would be suitable for the particular application. Furthermore, the water control valve 224 can be configured to be controlled by any suitable method, including manually controlled, electronically controlled, pneumatically controlled, and/or hydraulically controlled. Similarly, the control valve 214 can be any type of valve suitable for the application. For example, the control valve 214 can be a ball valve, a plug valve, a butterfly valve, a gate valve, a globe valve, a needle valve, a coaxial valve, an angle seat valve, a three-way valve, or any other type of valve that would be suitable for the particular application. Furthermore, the control valve 214 can be configured to be controlled by any suitable method, including manually controlled, electronically controlled, pneumatically controlled, and/or hydraulically controlled. As a non-limiting example, the control valve 214 can be a normally-closed solenoid valve that is configured to open when energized.

The compressor 202 can be any type of compressor. For example, the compressor 202 can be a positive displacement compressor, a reciprocating compressor, a rotary screw compressor, a rotary vane compressor, a rolling piston compressor, a scroll compressor, an inverter compressor, a diaphragm compressor, a dynamic compressor, an axial compressor, or any other form of compressor that can be integrated into the HWPH 200 for the particular application. Furthermore, the compressor 202 can be a fixed speed or a variable speed compressor depending on the application.

The condenser 204, the evaporator 208, and the supplemental heat exchanger 210 can be or include any type of heat exchanger coil configured to facilitate heat transfer between fluids. The fluid, for example, can be refrigerant, air, water, glycol, dielectric fluids, or any other type of fluid suitable for the particular application. The condenser 204, the evaporator 208, and the supplemental heat exchanger 210 can be or include, for example, a shell and tube heat exchanger, a double pipe heat exchanger, a plate heat exchanger, or any other suitable heat exchanger for the application.

Figure 3A:
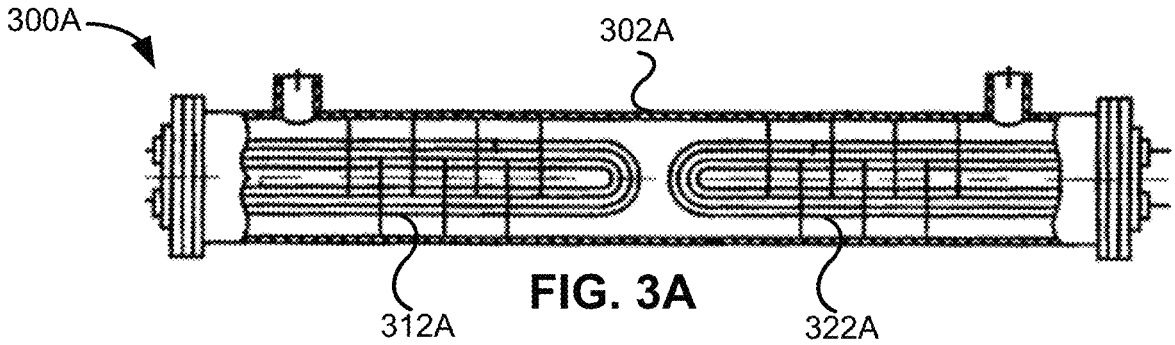
FIG. 3A-3C illustrate example multi-fluid heat exchangers, in accordance with the disclosed technology.
Figure 3B:
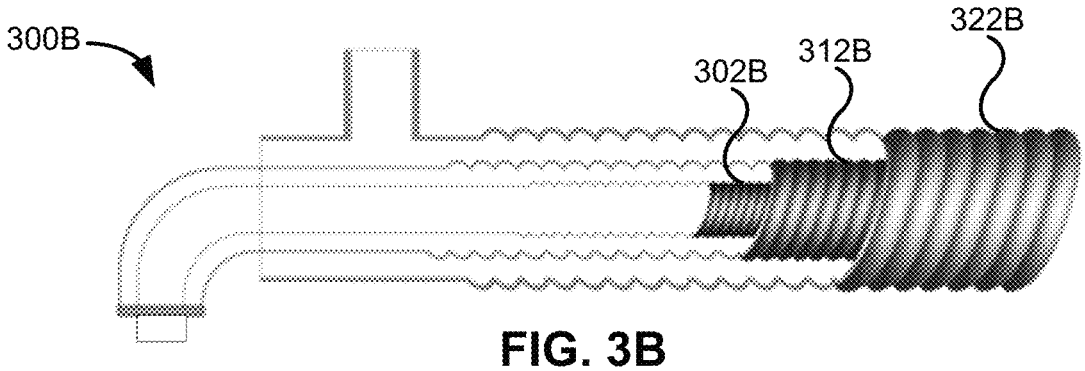
Figure 3C:
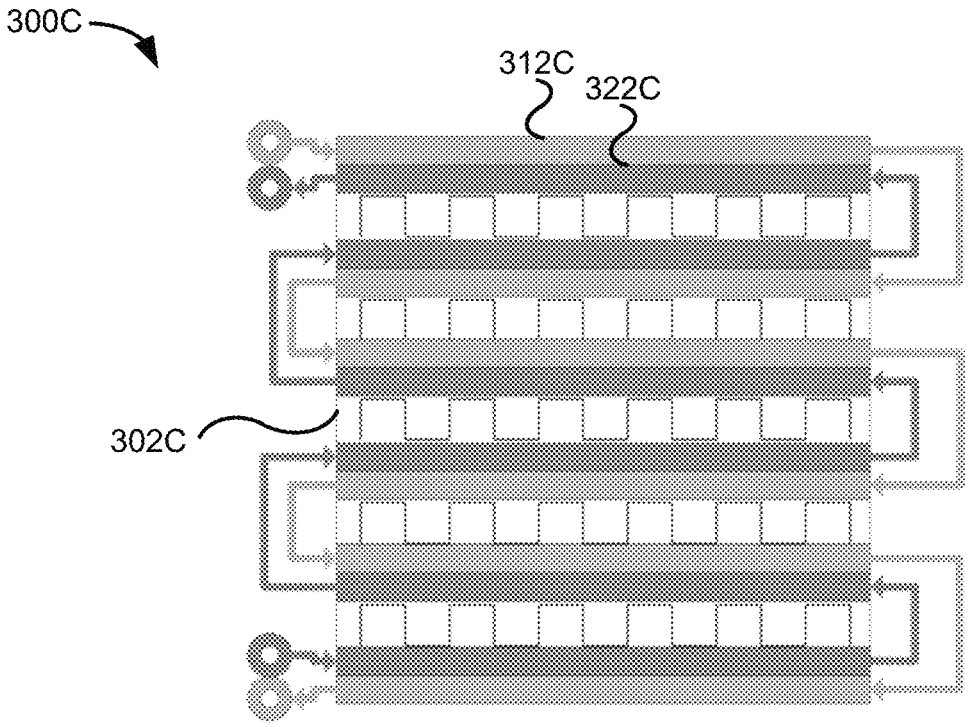

As described above, the supplemental heat exchanger 210 can be configured to facilitate heat transfer between at least three fluids (e.g., at least the high-pressure two-phase fluid refrigerant, the intermediate-pressure two-phase fluid refrigerant, and the water). FIGS. 3A-3C illustrate various examples of the supplemental heat exchanger 210 being a multi-fluid heat exchanger. Specifically, FIG. 3A illustrates a shell and tube heat exchanger 300A having a shell 302A and two tube bundles (i.e., 322A and 322B), FIG. 3B illustrates a tube-in-tube heat exchanger 300B having three tubes (i.e., 302B, 312B, and 322B), and FIG. 3C illustrates a microchannel heat exchanger 300C having two microchannel tubes (i.e., 312C, 322C) and plates 302C. As will be appreciated by one of skill in the art, the supplemental heat exchanger 210 can be configured such that the high pressure two-phase or liquid refrigerant coming from the condenser 204 can exchange heat with the incoming water only, with the low pressure two-phase or liquid refrigerant only, or both simultaneously.

Turning to FIG. 3A, the supplemental heat exchanger 210 can be a shell and tube heat exchanger 300A having a shell 302A, a first tube bundle 312A, and a second tube bundle 322A. The shell 302A can be configured to receive the high-pressure two-phase fluid refrigerant from the condenser 204, the first tube bundle 312A can be configured to receive the intermediate-pressure two-phase fluid refrigerant, and the second tube bundle 322A can be configured to receive the water. In this way, the shell and tube heat exchanger 300A can be configured to facilitate heat transfer between the three fluids. Because the high-pressure two-phase fluid refrigerant can be passed through the shell 302A, the high-pressure two-phase fluid refrigerant can heat both the water and the intermediate-pressure two-phase fluid refrigerant.

The tube-in-tube heat exchanger 300B illustrated in FIG. 3B can include a first tube 302B that can be positioned at least partially within a second tube 312B and the second tube 312B can be at least partially positioned within a third tube 322B. The first tube 302B can be configured to receive the water, The second tube 312B can be configured to receive the high-pressure two-phase fluid refrigerant from the condenser 204, and the third tube 322B can be configured to receive the intermediate-pressure two-phase fluid refrigerant. In this way, the tube-in-tube heat exchanger 300B can be configured to facilitate heat transfer between the three fluids. Because the high-pressure two-phase fluid refrigerant is passed through the second tube 312B, the high-pressure two-phase fluid refrigerant can heat both the water and the intermediate-pressure two-phase fluid refrigerant. To further facilitate heat transfer, the high-pressure two-phase fluid refrigerant can be configured to be in counterflow with both the intermediate-pressure two-phase fluid and the water.

As illustrated in FIG. 3C, the supplemental heat exchanger 210 can be a microchannel heat exchanger 300C having a first microchannel tube 312C, a second microchannel tube 322C and plates 302C. The plates 302C can include fins that are offset to further help facilitate heat transfer. The first microchannel tube 312C can be configured to receive the high-pressure two-phase fluid refrigerant from the condenser 204, the second microchannel tube 322C can be configured to receive the intermediate-pressure two-phase fluid refrigerant, and the plates 302C can be configured to contact the water passing through the microchannel heat exchanger 300C. In this way, the shell and tube heat exchanger 300A can be configured to facilitate heat transfer between the three fluids. As will be appreciated, the first microchannel tube 312C and the second microchannel tube 322C can each be configured to pass multiple times through the microchannel heat exchanger 300C to facilitate heat transfer. Furthermore, the plates 302C can be configured such that the water is received through an inlet, passed through the microchannel heat exchanger 300C (e.g., into and out of the page with each row of plates 302C) multiple times, and exits the microchannel heat exchanger 300C through an outlet. Because the high-pressure two-phase fluid refrigerant is passed through the first microchannel tube 312C, the high-pressure two-phase fluid refrigerant can heat both the water and the intermediate-pressure two-phase fluid refrigerant. To further facilitate heat transfer, the high-pressure two-phase fluid refrigerant can be configured to be in counterflow with the intermediate-pressure two-phase fluid.

Figure 4:
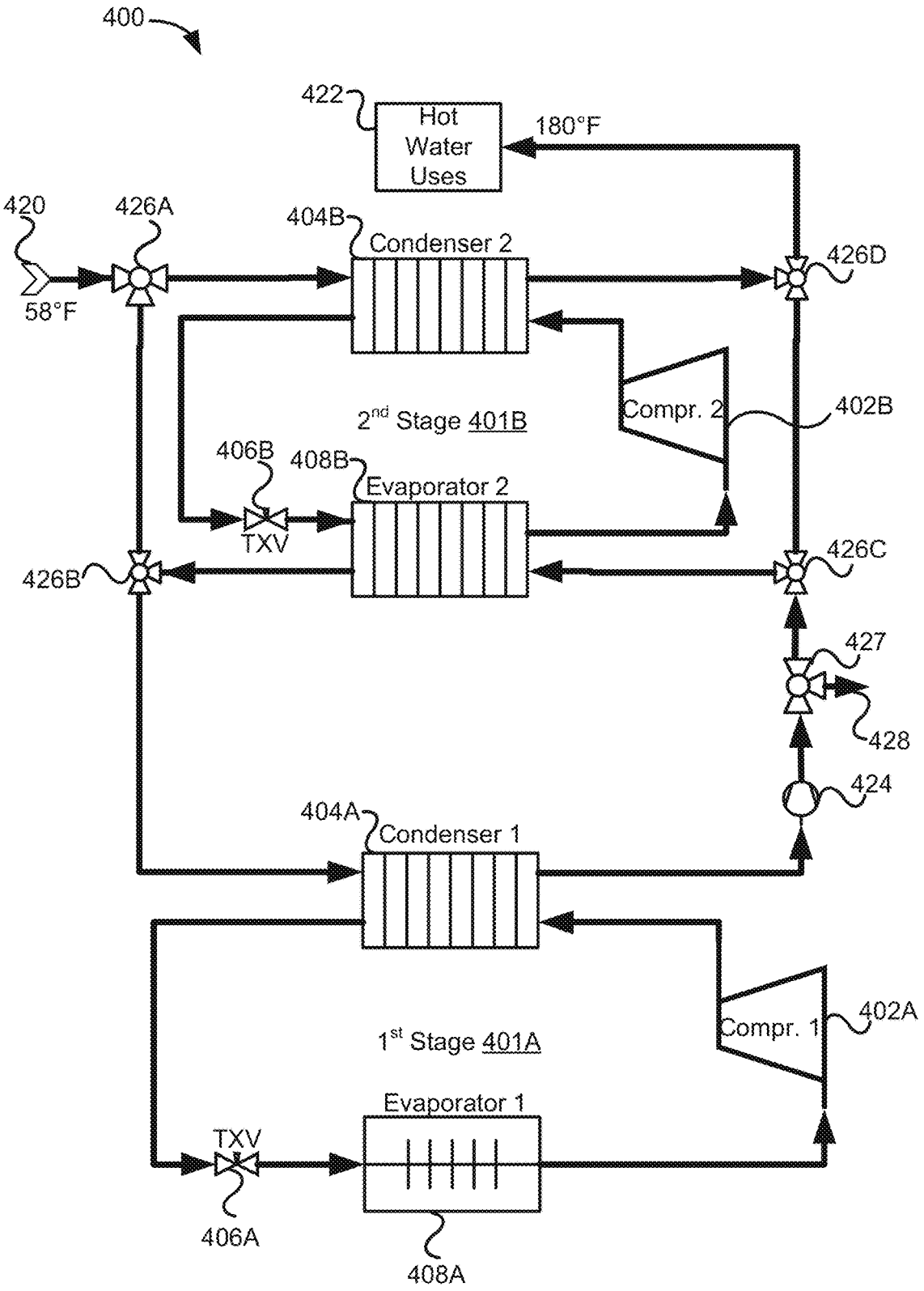
FIG. 4 illustrates a schematic diagram of an example cascade heat pump water heater system, in accordance with the disclosed technology.

FIG. 4 illustrates a schematic diagram of a cascade heat pump water heater system (HPWH) 400, in accordance with the disclosed technology. As will be appreciated, each of the components of the cascade HPWH 400 can be the same or similar to corresponding components of the HPWH 200 just described. The cascade HPWH 400 can include a first stage 401A and a second stage 401B. The first stage 401A can include a first compressor 402A, a first condenser 404A, a first TXV 406A, a first evaporator 408A and the second stage 401B can include a second compressor 402B, a second condenser 404B, a second TXV 406B, and a second evaporator 408B. The first stage 401A and the second stage 401B can be configured to operate concurrently or independently of each other. Furthermore, the components of the first stage 401A and the second stage 401B can each be the same type of components or different types of components (e.g., the first compressor 402A can be a compressor having the same capacity or a different capacity as the second compressor 402B).

As explained in relation to FIG. 1B, cascading HPWH systems are generally designed to heat water to a higher temperature in cooler climates than would otherwise be achievable with a single HPWH. Existing HPWH systems, however, are generally inefficient due to both stages being required to operate simultaneously. Unlike existing HPWH systems, the cascade HPWH 400 can be effectively implemented in both cool and warm climates and for various uses by being able to control the first stage 401A and the second stage 401B independently of each other. To illustrate, in a first mode, the cascade HPWH 400 can be configured such that water entering the cascade HPWH 400 from a water source 420 can be heated by only the first condenser 404A with only the first stage 401A being in operation. In a second mode, the water entering the HPWH 400 from the water source 420 can be heated by the second condenser 404B with both the first stage 401A and the second stage 401B being in operation. In a third mode, the water entering the HPWH 400 from the water source 420 can be heated by both the first condenser 404A and the second condenser 404B with both the first stage 401A and the second stage 401B being in operation.

To facilitate heating of the water with only a single stage or both stages in operation, the cascade HPWH 400 can include one or more water control valves 426A-426D that can be positioned and configured to permit or prevent water from flowing through the first condenser 404A, the second condenser 404B, and/or the second evaporator 408B. To illustrate, in the first mode just described, the water control valves 426A-426D can be actuated such that the water enters the HPWH 400 from the water source 420 and passes through, and is heated by, only the first condenser 404A before being used for various hot water uses 422. In this mode, only the first stage 401A can be operated with the second stage 401B being shut down or otherwise in a standby mode. The various hot water uses 422 can be or include any of the hot water uses 222 previously described. As will be appreciated by one of skill in the art, the first mode just described can be used to heat water when the load is low (e.g., when the ambient temperature is greater than a threshold temperature, the water source 420 water temperature is greater than a threshold temperature, the water temperature of the hot water uses 422 is less than a threshold temperature the demand for heated water is low, etc.). Furthermore, although not shown in FIG. 4, the cascade HPWH 400 can be configured to facilitate space heating similar to the HPWH 200. For example, the water can be circulated through a space heating system and then back through the first condenser 404A (or second condenser 404B depending on the configuration) to be reheated.

In the second mode, the water control valves 426A-426D can be actuated such that water entering from the water source 420 passes only through the second condenser 404B before being used for the various hot water uses 422. The water control valves 426A-426D can also be actuated such that a closed fluid loop between the first condenser 404A and the second evaporator 408B can be formed. In other words, the control valves 426A-426D can be actuated such that water can flow between control valves 426A and 426D but no water flows between control valves 426A and 426B. Similarly, water can flow between control valves 426C and 426B but not between control valves 426C and 426D to form the closed fluid loop. The water in the closed fluid loop can be circulated between the first condenser 404A and the second evaporator 408B by a water pump 424 to facilitate heat transfer between the first condenser 404A and the second evaporator 408B. In other words, water in the closed fluid loop can be heated by the first condenser 404A and then heat can be transferred from the water in the closed fluid loop to the refrigerant in the second stage 401B by the second evaporator 408B. The heated refrigerant in the second stage 401B can then transfer heat to water entering the cascade HPWH 400 from the water source 420 to heat the water for the various hot water uses 422. To facilitate further heating of the water for the various hot water uses 422, the second compressor 402B can be configured to compress the refrigerant in the second stage 401B to a higher pressure than the first compressor 402A. Furthermore, depending on the application, the refrigerant used in the first stage 401A can be the same type or a different type of refrigerant than the refrigerant used in the second stage 401B. If the refrigerant in the second stage 401B is a different refrigerant than the refrigerant in the first stage 401A, the refrigerant in the second stage 401B can be, for example, a refrigerant capable of being compressed to higher pressures. As a non-limiting example, R-32, R-290, R-410A, R-454B, R-454C, R-457A, R-468C, R-744 or other similar refrigerants can be used in the first stage 401A while ($CO_2$), R-134a, R-1234yf, R-513A, R-515B, and R-516A or other similar refrigerants can be used in the second stage 401B.

As will be appreciated, both the first stage 401A and the second stage 401B can be operated in this second mode such that the water in the closed fluid loop can be preheated by the first stage 401A. The preheated water can then act as a greater heat source for the second stage 401B than would otherwise be available by the ambient air alone. For example, even in climates where traditional HPWHs would be unable to heat water to a sufficient temperature, the cascade HPWH 400 can be used to sufficiently heat water for various uses because of the cascading configuration. Furthermore, as will be appreciated by one of skill in the art, when the ambient air temperature rises and the cascade configuration is no longer necessary for heating the water, the cascade HPWH 400 can operate only the first stage 401A to heat the water and conserve energy as described.

Furthermore, the cascade HPWH 400 can be configured to facilitate space heating in the second mode just described by circulating water from the closed fluid loop to the space heating (e.g., floor heating, radiators, etc.). For example, the cascade HPWH 400 can be configured such that, when the control valves 426A-426D are actuated to form the closed fluid loop, the water pump 424 can circulate water from the closed fluid loop to various locations for space heating. The water can then be circulated back through the first condenser 404A to be reheated. Alternatively, or in addition, water passing through the second stage 401B (e.g., passing through the second condenser 404B) can be used for space heating by being circulated back through the second condenser 404B.

The cascade HPWH 400 can be further configured to operate in a third mode with the control valves 426A-426D being actuated such that water entering from the water source 420 will pass through both the first condenser 404A and the second condenser 404B. Some of the water passing through the first condenser 404A can be used for space heating or domestic water heating while the rest of the water passing through the first condenser 404A can be used to heat the refrigerant in the second stage 401B via the second evaporator 408B. Furthermore, water passing through the second condenser 404B can be used for other hot water uses 422. For example, as shown in FIG. 4, a control valve 427 and an outlet 428 can be positioned between water pump 424 and control valve 426C. The outlet 428 and control valve 427 can be used to direct some of the water that has passed through the first condenser 404A to hot water uses which require the water at a temperature that is less than water delivered to the hot water uses 422. To illustrate, the water delivered from the first condenser 404A through the outlet 428 between water pump 424 and control valve 426C can be at approximately 120° F. and the water delivered from the second condenser 404B to the hot water uses 422 can be at approximately 140° F.

Figure 5:
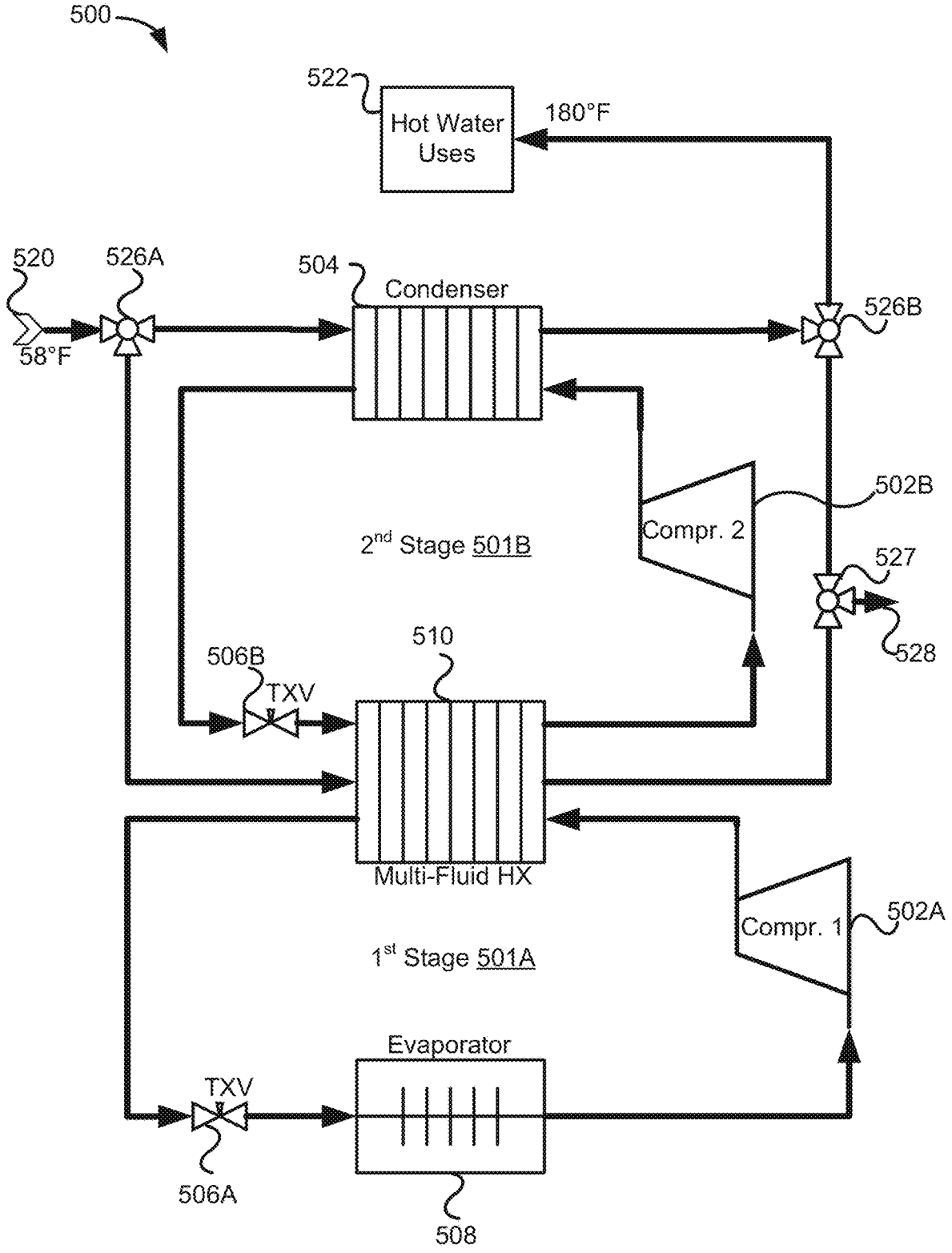
FIG. 5 illustrates a schematic diagram of an example cascade heat pump water heater system, in accordance with the disclosed technology.

FIG. 5 illustrates a schematic diagram of another cascade HPWH 500, in accordance with the disclosed technology. As will be appreciated, unless explicitly stated otherwise, each of the components of the cascade HPWH 500 can be the same or similar to corresponding components of the HPWH 200 and the cascade HPWH 400 described herein. The cascade HPWH 500 can include a first stage 501A and a second stage 501B. The first stage 501A can include a first compressor 502A, a first TXV 506A, and an evaporator 508A and the second stage 501B can include a second compressor 502B, a condenser 504, and a second TXV 506B. The components of the first stage 501A and the second stage 501B can each be the same type of components or different types of components (e.g., the first compressor 502A can be a compressor having the same capacity or a different capacity as the second compressor 502B). The cascade HPWH 500 can further include a multi-fluid heat exchanger 510 that can be in place of the first condenser 404A and the second evaporator 408B described in relation to the cascade HPWH 400. As will become apparent, by including a multi-fluid heat exchanger 510, the first stage 501A and the second stage 501B can be configured to operate concurrently or independently of each other with the cascade HPWH 500 being more compact.

Similar to the cascade HPWH 400, the cascade HPWH 500 can be configured such that in a first mode only the first stage 501A is in operation. Control valves 526A, 526B can be actuated such that water entering from the water source 520 can bypass the condenser 504 and pass only through the multi-fluid heat exchanger 510. With only the first stage 501A being operated, the water will be heated by heat transfer from the refrigerant of the first stage 501A via the multi-fluid heat exchanger 510. In other words, the multi-fluid heat exchanger 510 can act as a condenser to heat the water before the water is delivered to the hot water uses 522. The cascade HPWH 500 can be configured to operate in this first mode when the load is low (e.g., when the ambient temperature is greater than a threshold temperature, the water temperature is less than a threshold temperature, the demand for heated water is low, etc.).

In a second mode, the cascade HPWH 500 can be configured to operate with both the first stage 501A and the second stage 501B operating. Control valves 526A, 526B can be actuated such that water entering from the water source 520 can pass through only the condenser 504 before being used for the various hot water uses 522. Refrigerant in the first stage 501A can receive heat from the ambient air via the evaporator 508 and transfer the heat to the refrigerant in the second stage 501B via the multi-fluid heat exchanger 510. As will be appreciated, by transferring heat from the refrigerant in the first stage 501A to refrigerant in the second stage 501B, the cascade HPWH 500 can heat the water to a higher temperature than would otherwise be achievable without the cascading configuration. Furthermore, because the refrigerant in the first stage 501A is capable of transferring heat directly to the refrigerant in the second stage 501B, the cascade HPWH 500 can operate more efficiently than the cascade HPWH 400 since there are no heat losses associated with transferring heat to the water circulated through a closed fluid loop (as does the cascade HPWH 400). The cascade HPWH 500 can be configured to operate in this second mode when the load is high (e.g., when the ambient temperature is less than a threshold temperature, the water source 420 water temperature is less than a threshold temperature, the water temperature of the hot water uses 422 is greater than a threshold temperature, the demand for heated water is high, etc.). Although not shown in FIG. 5, the cascade HPWH 500 can be further configured to facilitate space heating as described herein by having at least some of the water passed through the condenser 504 be used for space heating.

The cascade HPWH 500 can be further configured to operate in a third mode with the control valves 526A, 526B being actuated such that water entering from the water source 520 will pass through both the multi-fluid heat exchanger 510 and the condenser 504. The water passing through the multi-fluid heat exchanger 510 can be used to first heat the refrigerant in the multi-fluid heat exchanger 510 before being used for other uses such as space heating. Furthermore, water passing through the second condenser 504 can be used for other hot water uses 522. For example, a control valve 527 and an outlet 528 can be positioned between multi-fluid heat exchanger 510 and control valve 526CB. The outlet 528 and control valve 527 can be used to direct the water that has passed through the multi-fluid heat exchanger 510 to hot water uses which require the water at a temperature that is less than water delivered to the hot water uses 522. To illustrate, the water delivered from the multi-fluid heat exchanger 510 through the outlet 527 can be at approximately 120° F. and the water delivered from the condenser 504 to the hot water uses 522 can be at approximately 140° F.

The multi-fluid heat exchanger 510 can be any of the heat exchangers shown and described in relation to FIGS. 3A-3C. Specifically, the multi-fluid heat exchanger 510 can be a shell and tube heat exchanger 300A having a shell 302A and two tube bundles (e.g., 322A and 322B) as illustrated in FIG. 1, a tube-in-tube heat exchanger 300B having three tubes (e.g., 302B, 312B, and 322B) as illustrated in FIG. 3B, or a microchannel heat exchanger 300C having two microchannel tubes (e.g., 312C, 322C) and plates 302C as illustrated in FIG. 3C.

Figure 6:
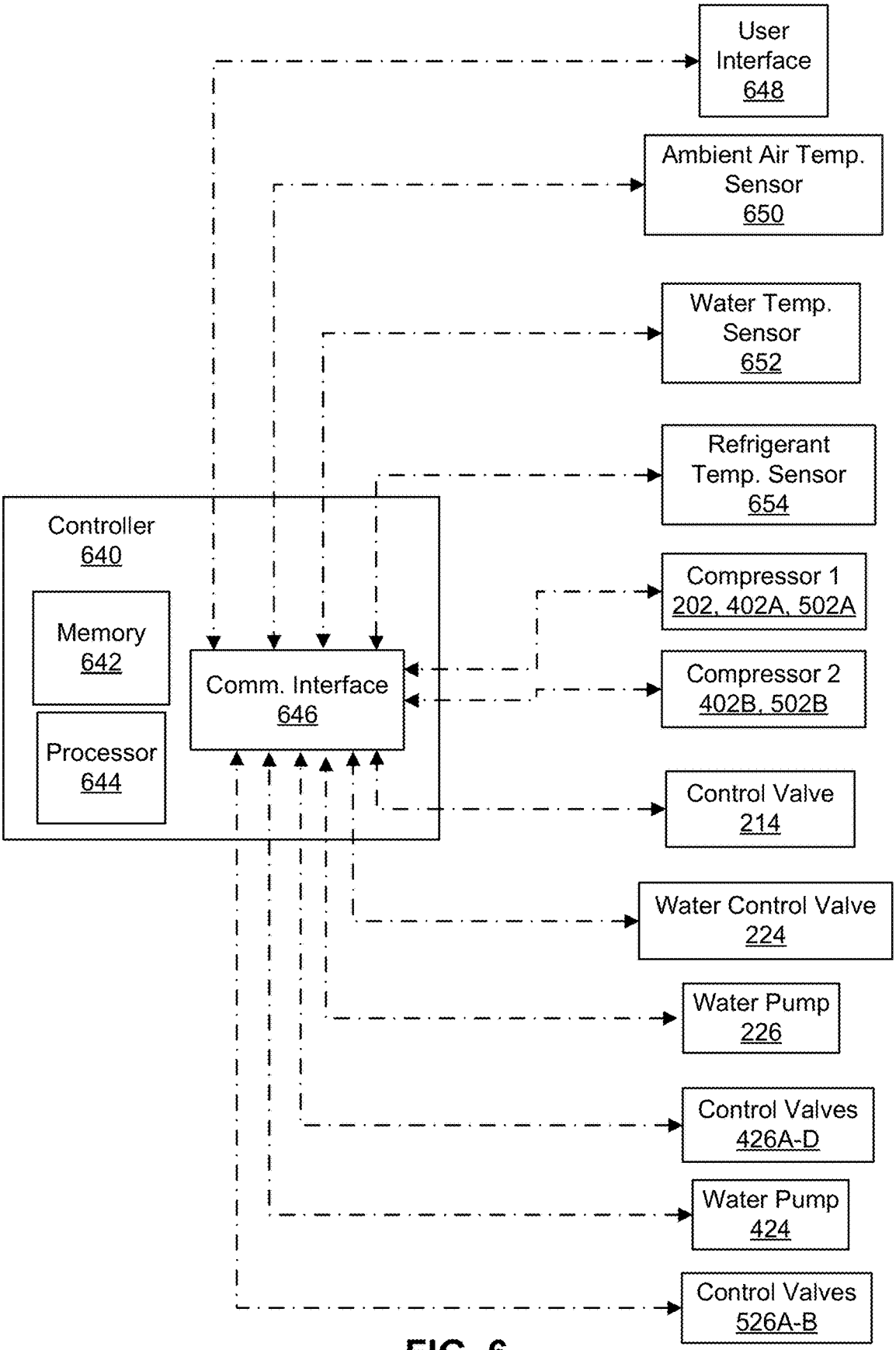
FIG. 6. illustrates a schematic diagram of an example controller and various components of a heat pump water heater system, in accordance with the disclosed technology.

FIG. 6. illustrates a schematic diagram of a controller 640 and various components of the HPWH systems described herein (i.e., HPWH 200, cascade HPWH 400, cascade HPWH 500), in accordance with the disclosed technology. As will be appreciated, the controller 640 can be configured to control any of HPWHs (i.e., HPWH 200, cascade HPWH 400, cascade HPWH 500) described herein. Thus, unless otherwise stated, when describing a HPWH in relation to FIG. 6, it will be understood that the HPWH can be any of HPWH 200, cascade HPWH 400, or cascade HPWH 500.

As illustrated in FIG. 6, the disclosed technology can include a controller 640 that can be configured to receive data and determine actions based on the received data. For example, the controller 640 can be configured to monitor the temperature of ambient air via an ambient air temperature sensor 650 and output control signals to the various components described herein to heat the water. As another illustrative example, the controller 640 can be configured to monitor the temperature of the water (e.g., water entering the HPWH 200, cascade HPWH 400, or cascade HPWH 500) via a water temperature sensor 652 and output control signals to the various components described herein to heat the water. As yet another illustrative example, the controller 640 can be configured to monitor the temperature of the refrigerant in the HPWH via a refrigerant temperature sensor 654 and output control signals to the various components described herein to heat the water. The controller 640 can receive data from, or output data to, the user interface 648, the ambient air temperature sensor 650, the water temperature sensor 652, the refrigerant temperature sensor 654, the first compressor (i.e., compressor 202, 402A, 502A), the control valve 214, the water control valve 224, the water pump 226, the control valves 426A-426D, the water pump 424, and/or the control valves 526A, 526B.

The ambient air temperature sensor 650 can be configured to detect a temperature of the ambient air proximate the HPWH. The water temperature sensor 652 can be configured to detect a temperature of the water supplied to the HPWH. The refrigerant temperature sensor 654 can be configured to detect a temperature of the refrigerant of the HPWH. Each of the temperature sensors can be any type of temperature sensor including a thermocouple, a resistance temperature detector, a thermistor, a semiconductor based integrated circuit, or any other suitable type of temperature sensor for the particular application.

The controller 640 can have a memory 642, a processor 644, and a communication interface 646. The controller 640 can be a computing device configured to receive data, determine actions based on the received data, and output a control signal instructing one or more components of the HPWH 200, cascade HPWH 400, or cascade HPWH 500, to perform one or more actions. One of skill in the art will appreciate that the controller 640 can be installed in any location, provided the controller 640 is in communication with at least some of the components of the system. Furthermore, the controller 640 can be configured to send and receive wireless or wired signals and the signals can be analog or digital signals. The wireless signals can include Bluetooth™, BLE, WiFi™, ZigBee™, infrared, microwave radio, or any other type of wireless communication as may be suitable for the particular application. The hard-wired signal can include any directly wired connection between the controller and the other components described herein. Alternatively, the components can be powered directly from a power source and receive control instructions from the controller 640 via a digital connection. The digital connection can include a connection such as an Ethernet or a serial connection and can utilize any suitable communication protocol for the application such as Modbus, fieldbus, PROFIBUS, SafetyBus p, Ethernet/IP, or any other suitable communication protocol for the application. Furthermore, the controller 640 can utilize a combination of wireless, hard-wired, and analog or digital communication signals to communicate with and control the various components. One of skill in the art will appreciate that the above modes and configurations are given merely as non-limiting examples and the actual configuration can vary depending on the particular application.

The controller 640 can include a memory 642 that can store a program and/or instructions associated with the functions and methods described herein and can include one or more processors 644 configured to execute the program and/or instructions. The memory 642 can include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including the operating system, application programs (including, for example, a web browser application, a widget or gadget engine, and or other applications, as necessary), executable instructions and data. One, some, or all of the processing techniques or methods described herein can be implemented as a combination of executable instructions and data within the memory.

The controller 640 can also have a communication interface 646 for sending and receiving communication signals between the various components. Communication interface 646 can include hardware, firmware, and/or software that allows the processor(s) 644 to communicate with the other components via wired or wireless networks or connections, whether local or wide area, private or public, as known in the art. Communication interface 646 can also provide access to a cellular network, the Internet, a local area network, or another wide-area network as suitable for the particular application.

Additionally, the controller 640 can have or be in communication with a user interface 648 for displaying system information and receiving inputs from a user. The user interface 648 can be installed locally or be a remotely controlled device such as a mobile device. The user, for example, can view system data on the user interface 648 and input data or commands to the controller 640 via the user interface 648. For example, the user can view temperature threshold settings on the user interface 648 and provide inputs to the controller 640 via the user interface 648 to change a temperature threshold setting. The temperature threshold settings can be, for example, an ambient air temperature threshold, a water temperature threshold, and/or a refrigerant temperature threshold.

Figure 7:
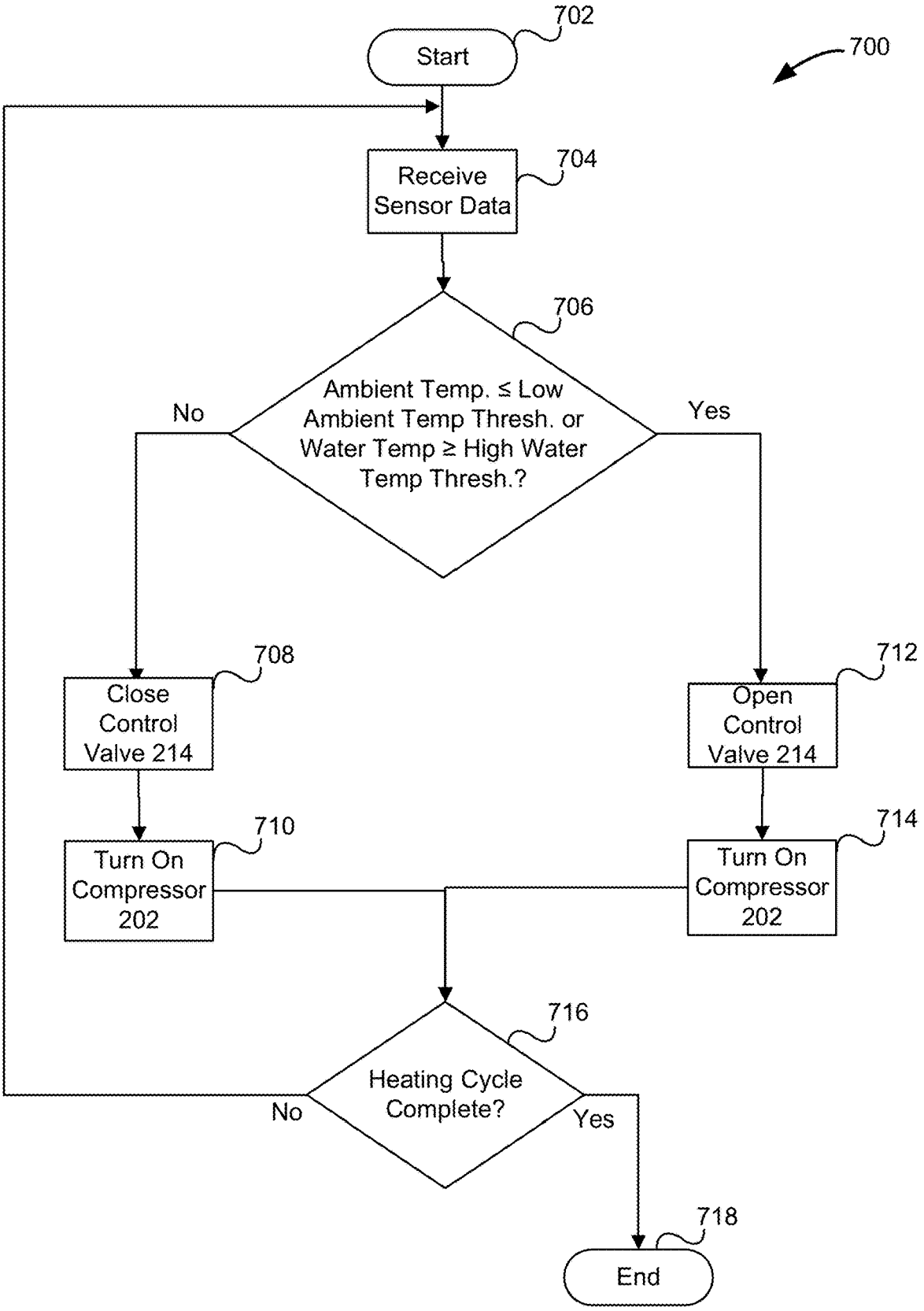
FIG. 7 illustrates a flow chart of an example method of operating a heat pump water heater system, in accordance with the disclosed technology.

FIG. 7 illustrates a flow chart of a method 700 of operating a heat pump water heater system (e.g., HPWH 200), in accordance with the disclosed technology. The method 700 can include starting 702 a logic sequence by receiving a start signal or by initiating the method 700 (e.g., as power is received to the controller 640). The method 700 can include receiving 704 sensor data from one or more sensors in the heat pump system (e.g., ambient temperature data from the ambient air temperature sensor 650, water temperature data from the water temperature sensor 652, refrigerant temperature data from the refrigerant temperature sensor 654, humidity data from a humidity sensor, flow data from a flow sensor, or any other data from a connected sensor).

The method 700 can include determining 706 whether the ambient temperature is less than or equal to a low ambient temperature threshold or whether the water temperature is greater than or equal to a high water temperature threshold. The low ambient temperature threshold can be, for example, a temperature of the ambient air wherein the HPWH begins to be unable to sufficiently heat the water to a water temperature threshold. For example, as will be appreciated by one of skill in the art, as the temperature of the ambient air begins to decrease to a low temperature (e.g., below a freezing temperature (32° F.)), the HPWH will begin to be unable to sufficiently heat the water for the various hot water uses (222, 422, or 522). In this scenario, the load on the HPWH will be high. Similarly, as the temperature of the water increases above a high water temperature threshold, the HPWH is less able to transfer heat from the refrigerant to the water because the temperature differential between the refrigerant and the water decreases. As the temperature of the water increases, the load on the HPWH will also begin to increase.

If the ambient temperature is greater than the low ambient temperature threshold or the water temperature is less than the high water temperature threshold, the method 700 can include outputting 708 a control signal to close control valve 214 to thereby cause refrigerant to bypass the vapor injection line 212 and pass only through the evaporator 208. The method 700 can further include outputting 710 a control signal to turn on compressor 202 to cause the refrigerant to circulate through the evaporator 208 and the condenser 204 to heat the water. The method 700 can include determining 716 whether the heating cycle is complete. The heating cycle can be complete, for example, when the water temperature has reached a threshold temperature (e.g., a target temperature), after the water has been heated for a predetermined length of time, when a demand for heated water is no longer present, when a temperature of a building is sufficiently heated by the space heating, and/or other conditions which would indicate that the water no longer needs to be heated. If the heating cycle is determined 716 to be complete, the method 700 can end 718 by shutting down the HPWH, placing the HPWH on standby mode, turning off the compressor 202, or other similar actions which would cause the HPWH to no longer heat the water. If the heating cycle is not complete, the method 700 can include once again receiving 704 the sensor data and continuing the method 700.

If the ambient air temperature is less than or equal to the low ambient temperature threshold or if the water temperature is greater than or equal to the high water temperature threshold, the method 700 can include outputting 712 a control signal to open control valve 214 to cause refrigerant to pass through the vapor injection line 212 and provide vapor injection to the compressor 202. The method 700 can further include outputting 714 a control signal to turn on compressor 202 to cause refrigerant to circulate through the condenser 204 and the evaporator 208. As will be appreciated by one of skill in the art, by injecting vapor refrigerant into the compressor 202, the compressor 202 can operate more efficiently to heat the water as described herein.

The method 700 can further include determining 716 whether the heating cycle is complete. If the heating cycle is determined 716 to be complete, the method 700 can end 718 by shutting down the HPWH, placing the HPWH on standby mode, turning off the compressor 202, or other similar actions which would cause the HPWH to no longer heat the water. If the heating cycle is not complete, the method 700 can include once again receiving 704 the sensor data and continuing the method 700.

Figure 8:
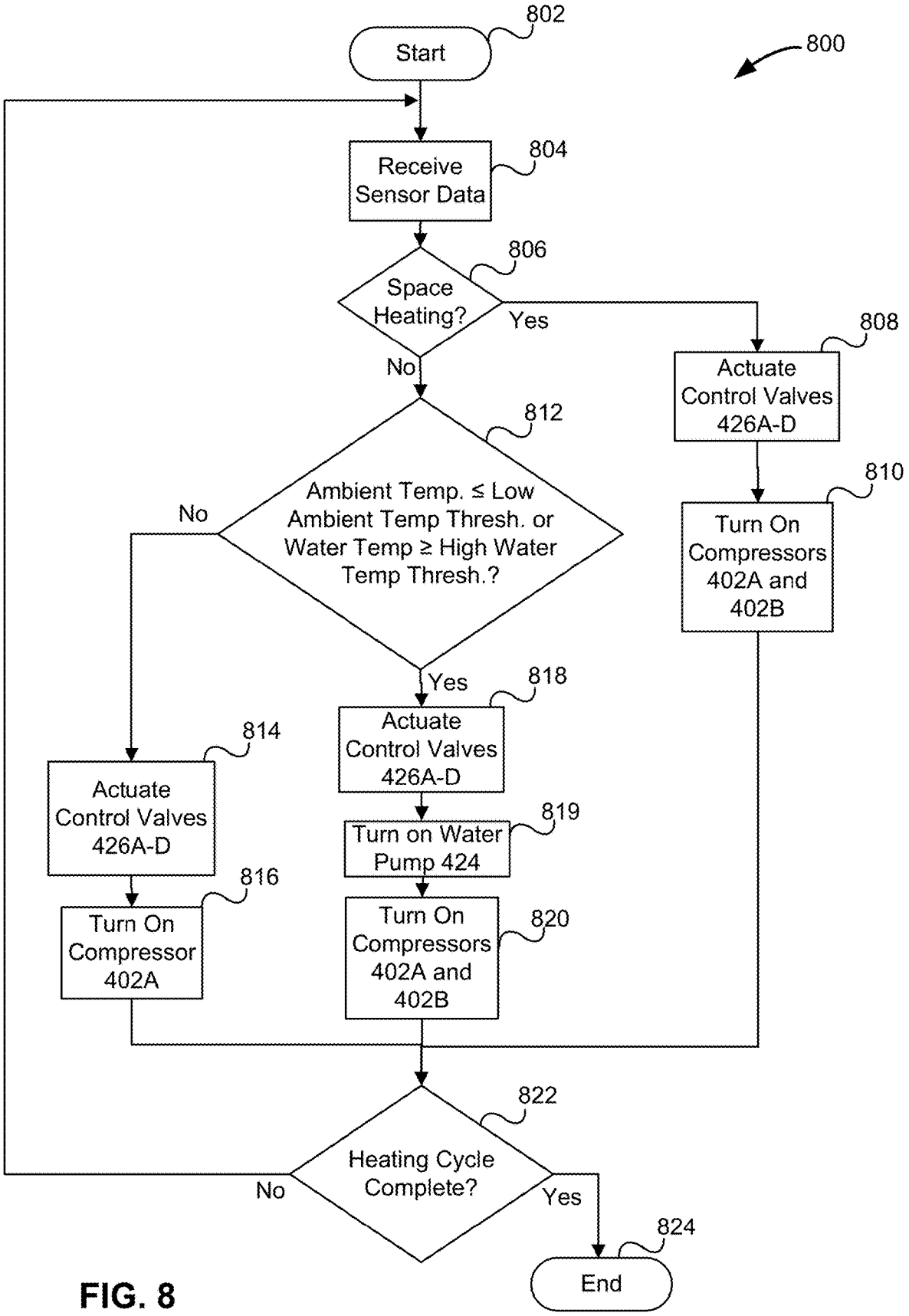
FIG. 8 illustrates a flow chart of an example method of operating a cascade heat pump water heater system, in accordance with the disclosed technology.

FIG. 8 illustrates a flow chart of a method 800 of operating a cascade heat pump water heater system (e.g., cascade HPWH 400), in accordance with the disclosed technology. The method 800 can include starting 802 a logic sequence by receiving a start signal or by initiating the method 800 (e.g., as power is received to the controller 640). The method 800 can include receiving 804 sensor data from one or more sensors in the heat pump system (e.g., ambient temperature data from the ambient air temperature sensor 650, water temperature data from the water temperature sensor 652, refrigerant temperature data from the refrigerant temperature sensor 654, humidity data from a humidity sensor, flow data from a flow sensor, or any other data from a connected sensor).

The method 800 can include determining 806 whether there is a demand for space heating. If there is a demand for space heating, the method can include performing actions to facilitate space heating as described herein with respect to FIG. 4. For example, and not limitation, the method 800 can include actuating 808 control valves 426A-426D to cause the water to flow through both the first condenser 404A and the second condenser 404B. The method 800 can further include outputting 810 a control signal to turn on the first compressor 402A and the second compressor 402B. As described with respect to FIG. 4, the cascade HPWH 400 can be configured to circulate at least a portion of the heated water through a space heating system (e.g., radiators, floor heating, etc.) to provide heat to a building.

If a demand for space heating is not present, the method 800 can include determining 812 whether the ambient temperature is less than or equal to a low ambient temperature threshold or whether the water temperature is greater than or equal to a high water temperature threshold. The low ambient temperature threshold can be, for example, a temperature of the ambient air wherein the HPWH begins to be unable to sufficiently heat the water to a water temperature threshold. For example, as will be appreciated by one of skill in the art, as the temperature of the ambient air begins to decrease to a low temperature (e.g., below a freezing temperature (32° F.)), the HPWH will begin to be unable to sufficiently heat the water for the various hot water uses (222, 422, or 522). In this scenario, the load on the HPWH will be high. Similarly, as the temperature of the water increases above a high water temperature threshold, the HPWH is less able to transfer heat from the refrigerant to the water because the temperature differential between the refrigerant and the water decreases. As the temperature of the water increases, the load on the HPWH will also begin to increase.

If the ambient temperature is greater than the low ambient temperature threshold or the water temperature is less than the high water temperature threshold, the method 800 can include outputting 814 a control signal to actuate control valves 426A-426D to cause the water entering the HPWH from the water source 420 to pass only through the first condenser 404A. The method 800 can further include outputting 816 a control signal to turn on the first compressor 402A to cause the refrigerant to circulate through the first evaporator 408A and the first condenser 404A to heat the water. The method can include determining 822 whether the heating cycle is complete. The heating cycle can be complete, for example, when the water temperature has reached a threshold temperature (e.g., a target temperature), after the water has been heated for a predetermined length of time, when a demand for heated water is no longer present, when a temperature of a building is sufficiently heated by the space heating, and/or other conditions which would indicate that the water no longer needs to be heated. If the heating cycle is determined 822 to be complete, the method 800 can end 824 by shutting down the HPWH, placing the HPWH on standby mode, turning off the compressor 202, or other similar actions which would cause the HPWH to no longer heat the water. If the heating cycle is not complete, the method 800 can include once again receiving 804 the sensor data and continuing the method 800.

If the ambient air temperature is less than or equal to the low ambient temperature threshold or if the water temperature is greater than or equal to the high water temperature threshold, the method 800 can include outputting 818 a control signal to actuate control valves 426A-426D to cause the water to flow from the water source 420 directly to the second condenser 404B. Outputting 818 the control signal to actuate the control valves 426A-426D can also cause the control valves 426A-426D to actuate and create a closed fluid loop where water can be circulated between the first condenser 404A and the second evaporator 408B. The method 800 can include outputting 819 a control signal to cause the water pump 424 to begin circulating water in the closed fluid loop. The method 800 can further include outputting 820 a control signal to turn on the first compressor 402A and the second compressor 402B to cause refrigerant to circulate in both the first stage 401A and the second stage 401B.

The method 800 can further include determining 822 whether the heating cycle is complete. If the heating cycle is determined 822 to be complete, the method 800 can end 824 by shutting down the HPWH, placing the HPWH on standby mode, turning off the compressor 202, or other similar actions which would cause the HPWH to no longer heat the water. If the heating cycle is not complete, the method 800 can include once again receiving 804 the sensor data and continuing the method 800.

Figure 9:
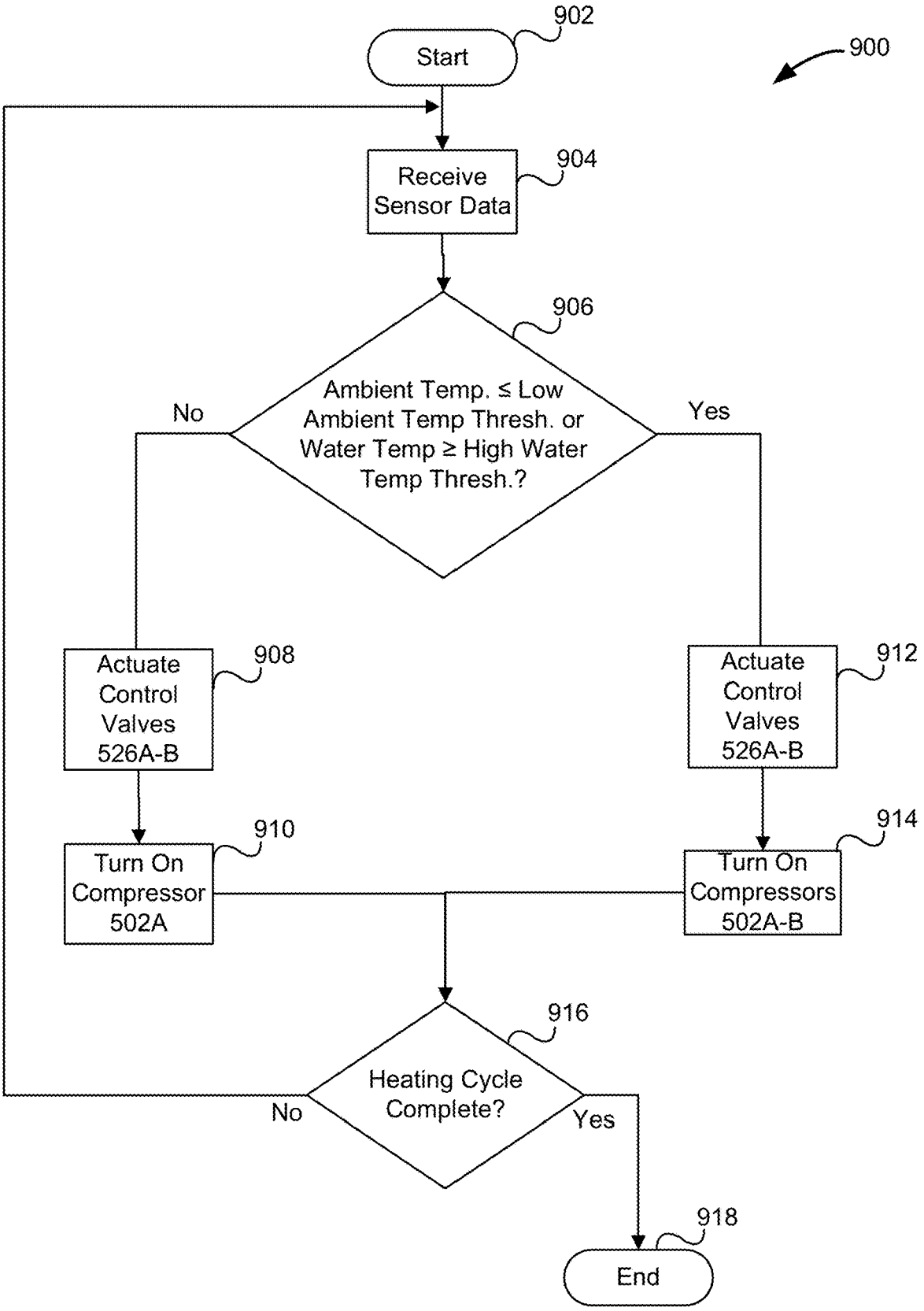
FIG. 9 illustrates a flow chart of an example method of operating a cascade heat pump water heater system, in accordance with the disclosed technology.

FIG. 9 illustrates a flow chart of a method 900 of operating a cascade heat pump water heater system (e.g., cascade HPWH 500), in accordance with the disclosed technology. The method 900 can include starting 902 a logic sequence by receiving a start signal or by initiating the method 900 (e.g., as power is received to the controller 640). The method 900 can include receiving 904 sensor data from one or more sensors in the heat pump system (e.g., ambient temperature data from the ambient air temperature sensor 650, water temperature data from the water temperature sensor 652, refrigerant temperature data from the refrigerant temperature sensor 654, humidity data from a humidity sensor, flow data from a flow sensor, or any other data from a connected sensor).

The method 900 can include determining 906 whether the ambient temperature is less than or equal to a low ambient temperature threshold or whether the water temperature is greater than or equal to a high water temperature threshold. The low ambient temperature threshold can be, for example, a temperature of the ambient air wherein the HPWH begins to be unable to sufficiently heat the water to a water temperature threshold. For example, as will be appreciated by one of skill in the art, as the temperature of the ambient air begins to decrease to a low temperature (e.g., below a freezing temperature (32° F.)), the HPWH will begin to be unable to sufficiently heat the water for the various hot water uses (222, 422, or 522). In this scenario, the load on the HPWH will be high. Similarly, as the temperature of the water increases above a high water temperature threshold, the HPWH is less able to transfer heat from the refrigerant to the water because the temperature differential between the refrigerant and the water decreases. As the temperature of the water increases, the load on the HPWH will also begin to increase.

If the ambient temperature is greater than the low ambient temperature threshold or the water temperature is less than the high water temperature threshold, the method 900 can include outputting 908 a control signal to actuate control valves 526A, 526B to cause the water to pass only through the multi-fluid heat exchanger 510 when entering the cascade HPWH 500 from the water source 520. The method 900 can further include outputting 910 a control signal to turn on the first compressor 502A to cause the refrigerant to circulate through the evaporator 508 and the multi-fluid heat exchanger 510 to heat the water. The method 900 can include determining 916 whether the heating cycle is complete. The heating cycle can be complete, for example, when the water temperature has reached a threshold temperature (e.g., a target temperature), after the water has been heated for a predetermined length of time, when a demand for heated water is no longer present, when a temperature of a building is sufficiently heated by the space heating, and/or other conditions which would indicate that the water no longer needs to be heated. If the heating cycle is determined 916 to be complete, the method 900 can end 918 by shutting down the HPWH, placing the HPWH on standby mode, turning off the compressor 202, or other similar actions which would cause the HPWH to no longer heat the water. If the heating cycle is not complete, the method 900 can include once again receiving 904 the sensor data and continuing the method 900.

If the ambient air temperature is less than or equal to the low ambient temperature threshold or if the water temperature is greater than or equal to the high water temperature threshold, the method 900 can include outputting 912 one or more control signals to actuate control valves 526A, 526B to cause the water to pass only through the condenser 504 to heat the water. The method 900 can further include outputting 914 a control signal to turn on the first compressor 502A and the second compressor 502B. As will be appreciated by one of skill in the art, by turning on the first compressor 502A and the second compressor 502B, the refrigerant in the first stage 501A can provide heat to the refrigerant in the second stage 501B and the refrigerant in the second stage 501B can provide heat to the water in the condenser 504, as previously described in relation to FIG. 5.

The method 900 can further include determining 916 whether the heating cycle is complete. If the heating cycle is determined 916 to be complete, the method 900 can end 918 by shutting down the HPWH, placing the HPWH on standby mode, turning off the compressor 202, or other similar actions which would cause the HPWH to no longer heat the water. If the heating cycle is not complete, the method 900 can include once again receiving 904 the sensor data and continuing the method 900.

As will be appreciated, the methods 700, 800, and 900 just described can be varied in accordance with the various elements and implementations described herein. That is, methods in accordance with the disclosed technology can include all or some of the steps or components described above and/or can include additional steps or components not expressly disclosed above. Further, methods in accordance with the disclosed technology can include some, but not all, of a particular step described above. Further still, various methods described herein can be combined in full or in part. That is, methods in accordance with the disclosed technology can include at least some elements or steps of a first method and at least some elements or steps of a second method.

The disclosed technology, although described in the context of being a heat pump water heating system, can be applicable to water cooling systems or other fluid cooling systems. For example, the HPWH 200 can be configured to circulate the refrigerant in a reverse direction such that the condenser 204 acts as an evaporator and the evaporator 208 acts as a condenser. In this way, the HPWH 200 can remove heat from water to sufficiently cool the water for end uses. This can be useful in applications where source water may be at temperature that is greater than the temperature of water necessary for the end use.

As mentioned previously, although described herein as being a heat pump water heating system, the disclosed technology can also be applicable to air heating and cooling systems (i.e., a heating ventilation and air conditioning (HVAC) system). For example, the HVAC system can be a system including all of the same components as those discussed in relations to the HPWH systems described herein. Furthermore, when in a heating mode, the HVAC system can operate similar to the HPWH system in that the compressor 202 (or first compressor 402A and second compressor 402B) and the control valves can circulate the refrigerant through the condenser 204 (or first condenser 404A and second condenser 404B, condenser 504), the evaporator 208 (or first evaporator 408A and second evaporator 408B, condenser 508), the supplemental heat exchanger 210, and/or the multi-fluid heat exchanger 510, to heat the air to a sufficient temperature in accordance with the methods and systems described herein.

When in a heating mode, the HVAC system can be configured to circulate the refrigerant in a reverse direction such that the condenser acts as an evaporator and the evaporator acts as a condenser. In this way, the HVAC system can remove heat from air circulated through a ventilated space to provide cooling to the ventilated space. As will be appreciated, the disclosed technology can be particularly helpful in areas having high ambient temperatures because the disclosed technology can be configured to cool air sufficiently even when ambient temperatures are high. Furthermore, as will be appreciated, rather than activating the first compressor(s) based on the ambient temperature being below a low ambient temperature, the HVAC system can be configured to activate the first compressors(s) based on the ambient temperature being greater than a high ambient temperature. Thus, one of skill in the art will understand that the disclosed technology can be applicable to HVAC systems while remaining within the scope of this disclosure.

While the present disclosure has been described in connection with a plurality of exemplary aspects, as illustrated in the various figures and discussed above, it is understood that other similar aspects can be used, or modifications and additions can be made to the described subject matter for performing the same function of the present disclosure without deviating therefrom. In this disclosure, methods and compositions were described according to aspects of the presently disclosed subject matter. But other equivalent methods or compositions to these described aspects are also contemplated by the teachings herein. Therefore, the present disclosure should not be limited to any single aspect, but rather construed in breadth and scope in accordance with the appended claims.

What is claimed is:

1. A heat pump water heater system comprising:

an evaporator configured to facilitate heat exchange between ambient air and a refrigerant;

a condenser configured to facilitate heat exchange between the refrigerant and water;

a vapor injection line comprising an expansion valve and configured to receive the refrigerant from the condenser, the expansion valve being configured to transition the refrigerant received from the condenser from a first pressure to a second pressure;

a compressor configured to circulate the refrigerant through the evaporator, the condenser, the vapor injection line, and a multi-fluid heat exchanger, wherein the multi-fluid heat exchanger comprises:

a first microchannel tube configured to receive the refrigerant at the first pressure from the condenser;

a second microchannel tube configured to receive the refrigerant at the second pressure from the vapor injection line; and a housing having a plurality of plates configured to receive the water from a water source;

wherein the multi-fluid heat exchanger is configured to facilitate heat exchange between the refrigerant at the first pressure, the refrigerant at the second pressure, and the water and wherein the first microchannel is disposed between the second microchannel and the plurality of plates, and the refrigerant at the first pressure heats both the refrigerant at the second pressure and the water;

wherein the condenser is configured to receive the water that is output from the multi-fluid heat exchanger.

2. The heat pump water heater system of claim 1 wherein the first pressure is greater than the second pressure.

3. The heat pump water heater system of claim 2 wherein, when the refrigerant at the second pressure passes through the multi-fluid heat exchanger, the refrigerant at the second pressure is transitioned into a superheated vapor by receiving heat from the refrigerant at the first pressure.

4. The heat pump water heater system of claim 3, wherein the compressor is further configured to receive the superheated vapor from the multi-fluid heat exchanger via the vapor injection line.

5. The heat pump water heater system of claim 1 wherein the water is configured to first pass through the multi-fluid heat exchanger and then through the condenser, the multi-fluid heat exchanger being configured to preheat the water.

6. The heat pump water heater system of claim 1 wherein the vapor injection line further comprises a control valve configured to control a flow of the refrigerant from the condenser.

7. The heat pump water heater system of claim 6 wherein the control valve comprises a solenoid valve.

8. The heat pump water heater system of claim 1 wherein the refrigerant at the first pressure and the refrigerant at the second pressure are configured to be in counterflow with respect to each other.

9. The heat pump water heater system of claim 1 further comprising:

a control valve configured to control a flow of the refrigerant from the condenser;

an ambient air temperature sensor configured to detect a temperature of ambient air; and a controller configured to:

receive ambient air temperature data from the ambient air temperature sensor;

determine, based at least in part on the ambient air temperature data, whether the temperature of the ambient air is less than or equal to a low ambient temperature threshold; and in response to determining that the temperature of the ambient air is less than or equal to the low ambient temperature threshold, output a control signal to open the control valve to permit the refrigerant to flow through the vapor injection line.

10. The heat pump water heater system of claim 9 wherein the controller is further configured to:

in response to determining that the temperature of the ambient air is greater than the low ambient temperature threshold, output a control signal to close the control valve to prevent the refrigerant from flowing through the vapor injection line.

11. The heat pump water heater system of claim 1 further comprising:

a control valve configured to control a flow of the refrigerant from the condenser;

a water temperature sensor configured to detect a temperature of the water; and a controller configured to:

receive water temperature data from the water temperature sensor;

determine, based at least is part on the water temperature data, whether the temperature of the water is greater than or equal to a high water temperature threshold; and in response to determining that the temperature of the water is greater than or equal to the high water temperature threshold, output a control signal to open the control valve.

12. The heat pump water heater system of claim 11 wherein the controller is further configured to:

in response to determining that the temperature of the water is less than the high water temperature threshold, output a control signal to close the control valve to prevent the refrigerant from flowing through the vapor injection line.

13. The heat pump water heater system of claim 1 wherein the multi-fluid heat exchanger is configured to pass the first refrigerant and the second refrigerant in counterflow directions therethrough.

14. The heat pump water heater system of claim 1, wherein a first portion of water that is output from the multi-fluid heat exchanger is recirculated through the condenser.

15. The heat pump water heater system of claim 14, wherein a second portion of the water that is output from the multi-fluid heat exchanger bypasses the condenser.

* * * * *